US008991631B2

(12) United States Patent
Kalchmair et al.

(10) Patent No.: US 8,991,631 B2
(45) Date of Patent: Mar. 31, 2015

(54) CONTAINER, IN PARTICULAR FOR BEVERAGES

(75) Inventors: Joachim Kalchmair, Piberbach (AT); Catherine Reiter, Strasswalchen (AT); Nathalie Mikhaeel, Salzburg (AT); Peter Huels, Kroev (DE); Roland Concin, Stallehr (AT); Gabriele Weber-Trinkfass, Salzburg (AT); Matthias Rinderer, Fuschl am See (AT)

(73) Assignee: Red Bull GmbH, Puschl Am See (AT)

( * ) Notice: Subject to any disclaimer, the term of this patent is extended or adjusted under 35 U.S.C. 154(b) by 2 days.

(21) Appl. No.: 13/990,775

(22) PCT Filed: Nov. 23, 2011

(86) PCT No.: PCT/EP2011/005886

§ 371 (c)(1),
(2), (4) Date: Aug. 30, 2013

(87) PCT Pub. No.: WO2012/072207

PCT Pub. Date: Jun. 7, 2012

(65) Prior Publication Data

US 2013/0334224 A1 Dec. 19, 2013

(30) Foreign Application Priority Data

Nov. 30, 2010 (DE) ..... 10 2010 052 750

(51) Int. Cl.

| | |
|---|---|
| ***B65D 51/22*** | (2006.01) |
| ***B65D 51/20*** | (2006.01) |
| ***B65D 1/02*** | (2006.01) |
| ***B65D 23/08*** | (2006.01) |
| ***B65D 47/06*** | (2006.01) |
| ***B65D 47/08*** | (2006.01) |

(Continued)

(52) U.S. Cl.

CPC ..... *B65D 51/20* (2013.01); *B65D 1/0223* (2013.01); *B65D 23/0878* (2013.01);

(Continued)

(58) Field of Classification Search

USPC ..... 220/258.4, 259.1, 254.3; 215/235, 247, 215/250

See application file for complete search history.

(56) References Cited

U.S. PATENT DOCUMENTS

| | | | | |
|---|---|---|---|---|
| 4,869,399 | A * | 9/1989 | Dubach | 222/83 |
| 5,383,558 | A | 1/1995 | Wilkinson | |

(Continued)

FOREIGN PATENT DOCUMENTS

| | | | |
|---|---|---|---|
| EP | 1 273 525 | A1 | 1/2003 |
| WO | 2006/092451 | A1 | 9/2006 |
| WO | 2007/121601 | A1 | 11/2007 |

OTHER PUBLICATIONS

International Search Report mailed Feb. 1, 2012, in International Application No. PCT/EP2011/005886, filed Oct. 25, 2011, 3 pages.

*Primary Examiner* — Jacob K Ackun
*Assistant Examiner* — Niki Eloshway
(74) *Attorney, Agent, or Firm* — Seed IP Law Group PLLC

(57) ABSTRACT

A beverage container comprises a body for receiving fluids, having a base, a first side wall adjoining the base, and an opening section adjoining the first side wall and having a discharge opening. The container further comprises a cover module that is placed on or is present on the body and has a second side wall and a cover flap adjacent thereto. When the cover module is present on the body, the first and the second side walls form an outline shape of the container, at least in sections, the diameter of which has at least one maximum. At least one film, at least in regions, rests on the first and second side walls, and extends on one side and an opposite side at the body at the at least one diameter maximum. The film may be a shrink film that is shrunk on the first and second side walls.

20 Claims, 3 Drawing Sheets

(51) Int. Cl.
*B65D 47/36* (2006.01)
*B65D 51/18* (2006.01)

(52) U.S. Cl.
CPC ..... *B65D 47/06* (2013.01); *B65D 47/0804* (2013.01); *B65D 47/36* (2013.01); *B65D 2251/0025* (2013.01); *B65D 2251/0093* (2013.01)
USPC ..... 220/258.4; 215/235; 215/250; 220/254.3

(56) References Cited

U.S. PATENT DOCUMENTS

| | | | | |
|---|---|---|---|---|
| 6,039,197 | A * | 3/2000 | Braun | 215/228 |
| 6,299,033 | B1 | 10/2001 | VerWeyst | |
| 6,305,563 | B1 * | 10/2001 | Elliott | 215/235 |
| 6,837,405 | B2 * | 1/2005 | Rainey et al. | 222/546 |
| 7,870,969 | B2 * | 1/2011 | Ribadeneira Mejia | 215/321 |
| 8,485,373 | B2 * | 7/2013 | Antier et al. | 215/253 |
| 8,608,001 | B2 * | 12/2013 | Stoneberg et al. | 215/235 |
| 8,646,633 | B2 * | 2/2014 | Huntington et al. | 215/237 |
| 2002/0039609 | A1 | 4/2002 | Bezek | |
| 2002/0175137 | A1 * | 11/2002 | Rousselet | 215/235 |
| 2004/0089678 | A1 | 5/2004 | Martin | |
| 2005/0274687 | A1 | 12/2005 | McCutchan | |
| 2008/0035674 | A1 | 2/2008 | Stoneberg | |
| 2009/0101618 | A1 | 4/2009 | Seelhofer | |
| 2011/0100991 | A1 * | 5/2011 | Voss et al. | 220/315 |

* cited by examiner

CONTAINER, IN PARTICULAR FOR BEVERAGES

FIELD

The present disclosure relates to a container, in particular for holding beverages, and the use of said container for filling, storing, transporting, and consuming fluids, in particular beverages.

BACKGROUND

Containers for beverages are currently not only increasingly used for the indirect provision of said beverages, but, to a far greater extent, these containers serve directly as beverage containers, i.e., beverages are directly drunk from said containers without the aid of a glass or cup. Beverage containers of this nature are, for example, frequently used during car journeys and can be stored in corresponding holders. In particular, one requirement of such containers is that they can be used conveniently and with just one hand. This applies both to the initial opening procedure as well as to the secure and tight re-closure of the container. Many beverages, particularly soft drinks, must be pasteurized or even sterilized in order to have a sufficient degree of product purity and shelf life. This occurs regularly with beverage containers as such. Filling the beverage containers under aseptic conditions is also required in many cases in order to guarantee that no germs are present in the beverages offered. These legal requirements regarding foodstuffs frequently present great challenges in relation to the materials used and the production process for beverage containers.

SUMMARY AND INITIAL DESCRIPTION

As a result, various aspects of the present disclosure overcome drawbacks known from the prior art for beverage containers and, in particular, provide containers that make it possible to prevent the contamination of fluids, such as beverages, during provision and/or filling. In particular, aspects of the present disclosure provide highly pure, e.g., contamination-free fluids, such as beverages, without being reliant, for example, on a pasteurization stage. Furthermore, aspects of the present disclosure provide such containers with which potential subsequent contamination or manipulation of a filled fluid, for example, a beverage, can be recognized in a simple manner by any user following completion of the filling.

In at least on embodiment, disclosed herein is a container, in particular for beverages, comprising a body for receiving fluids, having a base, a first side wall adjoining the base, and an opening section adjoining the first side wall, and having a discharge opening; a cover module that can be placed on or is present on the body and has a second side wall and a cover flap adjacent thereto, wherein, when the cover module is present on the body, the first and second side wall form an outline shape of the container, at least in some sections, the diameter of which runs through at least one maximum in the longitudinal direction of the container; and at least one film, in particular a shrink film, which, at least in some regions, in each case rests on the first and second side wall, and in particular is shrunk on, and which extends on one side and the other side of the at least one diameter maximum.

Suitable films that surround the first and second side wall at least in some regions and which rest on said wall, thus holding the body and cover module firmly together, can be produced from sufficiently known synthetic materials, such as polyolefin films including polyethylene and polypropylene films, or from polystyrene films or films made of styrene polymers. In at least one embodiment, the films used have a rubber elastic characteristic profile, as a result of which it is particularly easy to tightly apply the film over the entire surface area of the first and second side wall. The film preferably extends over the entire circumference of the container, thereby covering the first and second side wall at least in some sections. In various embodiments, the films are preferably subject to tension. The shrink film is preferably shrunk in such a manner on at least one section of the body and at least one section of the cover module that the body and the cover module cannot be displaced relative to each other or be removed from each other without destroying the shrink film. Suitable shrink films and methods for their production and application are sufficiently known to persons skilled in the art. For example, shrink films can be produced from polyolefins such as polyethylene or polypropylene, or from PVC. Advantageously, in one design, the film, in particular the shrink film, when in a shrunken state, extends in the direction of the cover module to a maximum extent of almost to the cover flap. If the film, in particular the shrink film, were also to be shrunk on the cover flap, this would unnecessarily complicate a functional opening of the container. As a result, with the containers described herein, the cover module is in particular attached or connected to the body by the film, in particular the shrink film, in such a manner that it cannot be lost.

Containers as described herein regularly constitute beverage containers, for example. These can be containers for soft drinks. It is also possible to use the containers described herein for holding, transporting, and consuming coffee, cocoa, or tea beverages, etc.

A container according to at least one preferred design is equipped with a separate, e.g., re-closable, first closing mechanism for closing the discharge opening of the container. Alternatively, or also additionally, it is certainly possible to close the discharge opening with the cover flap in a folded closed mode. The cover flap may comprise a second, in particular integral, closing mechanism for the discharge opening on a side facing towards the discharge opening, wherein this second closing mechanism closes the discharge opening when the cover flap is closed. The first closing mechanism of the discharge opening can, for example, comprise or be a film, in particular a destructible film, preferably a metal and/or plastic film.

In at least one advantageous design, a container as described herein furthermore has a destruction unit for the first closing mechanism. The cover module may be equipped with such a destruction unit. A further design provides that the first closing mechanism can be screwed or is screwed onto the discharge opening.

In a further embodiment, the opening section has at least one first attachment element, and the cover module has at least one second attachment element that is complementary to the first attachment element, wherein, due to the interaction between the first and second attachment element, the body and cover module can be connected, in particular, in a reversible manner.

In various embodiments of containers described herein, the first and second side wall form, at least in some sections, a concave outline shape, for example, as is known from wooden wine casks, which preferably comprises the at least one diameter maximum. Naturally, this outline shape that is formed by the first and second side wall does not necessarily have to be symmetric. In general, a longitudinal axis can easily be determined for containers with a base and a discharge opening opposite the base. The side wall of these containers, i.e., the first and second side wall, generally surrounds this virtual longitudinal axis. On the basis of such a longitudinal axis that is laid through a container, the diameter or progression of the diameter of the container can in general be determined from the base through to the discharge opening. The at least one diameter maximum of the outline shape may lie in the region of the first side wall or in the region of the second side wall. To the extent that the outline shape has no regular shape, and in particular offers several diameter values depending on the alignment at a level of the longitudinal axis, it has proven to be advantageous to use the maximum diameter respectively along the longitudinal axis of the outline shape. The film, which extends on this side and on the other side of the at least one diameter maximum, is the film that extends from this at least one diameter maximum both in the direction of the base and in the direction of the discharge opening.

The designs of a container according to the disclosure are particularly easy to handle and safe in terms of manipulation in which the outline shape formed by the first and second side wall has the largest bulge in the area of the first side wall, which then tapers in the direction of the base and the discharge opening.

The cover module and/or the body can at least at intervals be formed from glass, plastic, ceramic, and/or metal, or comprise these materials.

The first and second attachment element of the body or cover module are, for example, threads which complement each other.

The cover flap is preferably designed to be arrestable in an open and/or closed state. In this manner, the cover flap can be affixed in an open state in a position in which it does not inhibit the user while drinking.

In a particularly advantageous design, the cover flap is supported movably as a component of the cover module by way of a hinge, preferably an integral hinge.

In a further design of a container according to the disclosure, the cover flap also comprises an end area that is preferably connected to the second side wall. This end area can be designed with at least one drinking aid or a drinking edge that surrounds the discharge opening when the cover module is present on the body. The drinking edge present on the end area serves to make the drinking process as simple and safe as possible.

Containers of this type are particularly preferred in which the first and the second side wall essentially merge with each other seamlessly.

Furthermore, the first side wall has a circumferential placement edge onto which a section of the second side wall, preferably an edge of the second side wall, is placed or can be placed.

In a relatively simple manner, a beverage container according to the present disclosure can be obtained which, during production and during later use, permits an almost comprehensive check as to whether a contamination of the fluid present in the container, in particular a beverage, could have taken place. A container according to the disclosure is also easy and reliable to use, including with just one hand.

In various embodiments, containers according to the present disclosure can, without any problem, be filled under sterile conditions with fluids, for example, with beverages such as coffee or cocoa. A subsequent pasteurization of the beverage is not necessary. For this purpose, the sterilized body is filled under aseptic conditions with the fluid, in particular with the beverage, via the discharge opening. This discharge opening is then closed or sealed, and the body filled in this manner can be equipped with or connected to the cover module either in the aseptic filling area or after this area has been exited. The attachment of the film, in particular the shrinkage of the shrink film onto the container according to the present disclosure, is also preferably conducted outside of the aseptic area, although still within the sphere of influence of the filler. Thus, a quality check is already provided simply through the type of production specified by the container according to the present disclosure.

DESCRIPTION OF THE DRAWINGS

Further features and advantages of the invention are included in the description below, in which preferred embodiments of the invention are explained with reference to schematic drawings, in which.

DETAILED DESCRIPTION

Figure 1:
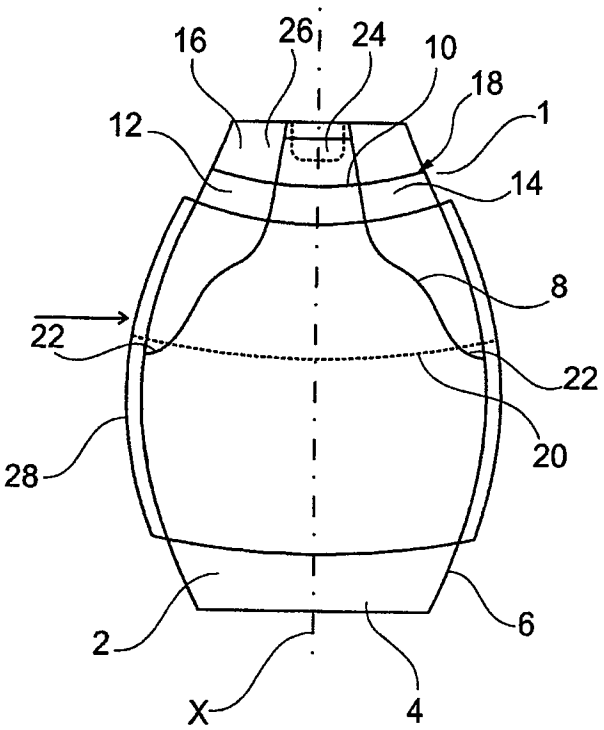
FIG. 1 shows a schematic side view of a first container according to the present disclosure.

FIG. 1 shows in a schematic side view an embodiment of a container 1 according to the present disclosure, comprising a body 2 for receiving a fluid with a base 4, a first side wall 6, an opening section 8, and a discharge opening 10. The opening section 8 merges with its circumference into the first side wall 6. Set onto the body 2 is a cover module 12. This cover module 12 comprises a second side wall 14 and a cover flap 16 that is connected via an integral hinge 18 to the second side wall 14. An edge 20 of the second side wall 14 stands on a circumferential edge 22 of the body 2. In the embodiment shown, a second closing mechanism 24 of the discharge opening 10 is an integral component of the cover flap 16. The second closing mechanism 24, which grips into the discharge opening 10 when the cover flap is folded closed, is completed by a sealing edge 26 that runs around the outer edge of the discharge opening 10. The first side wall 6 and the second side wall 14 form an outline shape that is curved outwards. If the diameter of this outline shape is regarded along a virtual longitudinal axis X (shown as a broken line) that extends from the base 4 through to the discharge opening 10, these diameters increase steadily when regarded from the base through to a specific point (shown by an arrow) from which the diameters decrease again, i.e., the outline shape formed by the first and second side wall tapers again. The container 1 according to the present disclosure is furthermore equipped with shrink film 28 that is shrunk onto the first and second side wall. This shrink film 28 extends on one side and on the other side of the maximum bulge. However, in the embodiment shown, the shrink film 28 does not extend beyond the second side wall 14, i.e., the cover flap 16 is preferably not covered by the shrink film 28.

Figure 2:
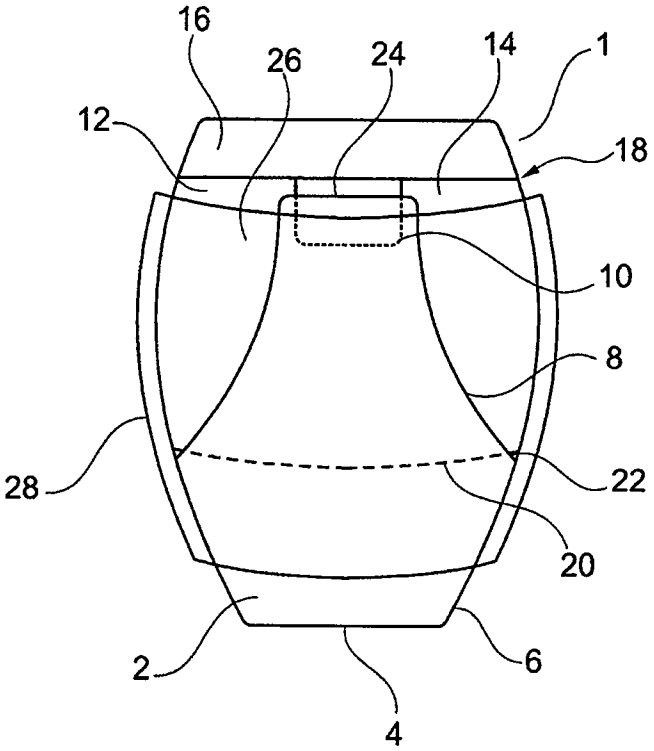
FIG. 2 shows a schematic side view of a second container according to the present disclosure.

The container 1 according to FIG. 2 only deviates from the embodiment shown in FIG. 1 in that the second side wall 14 creates by far the greater part of the outline shape than the first side wall 6, said outline shape being surrounded by the shrink film 28. With this embodiment, it is also ensured that the cover module is connected to the body in a simple manner, and in such a manner that it cannot be lost.

Figure 3:
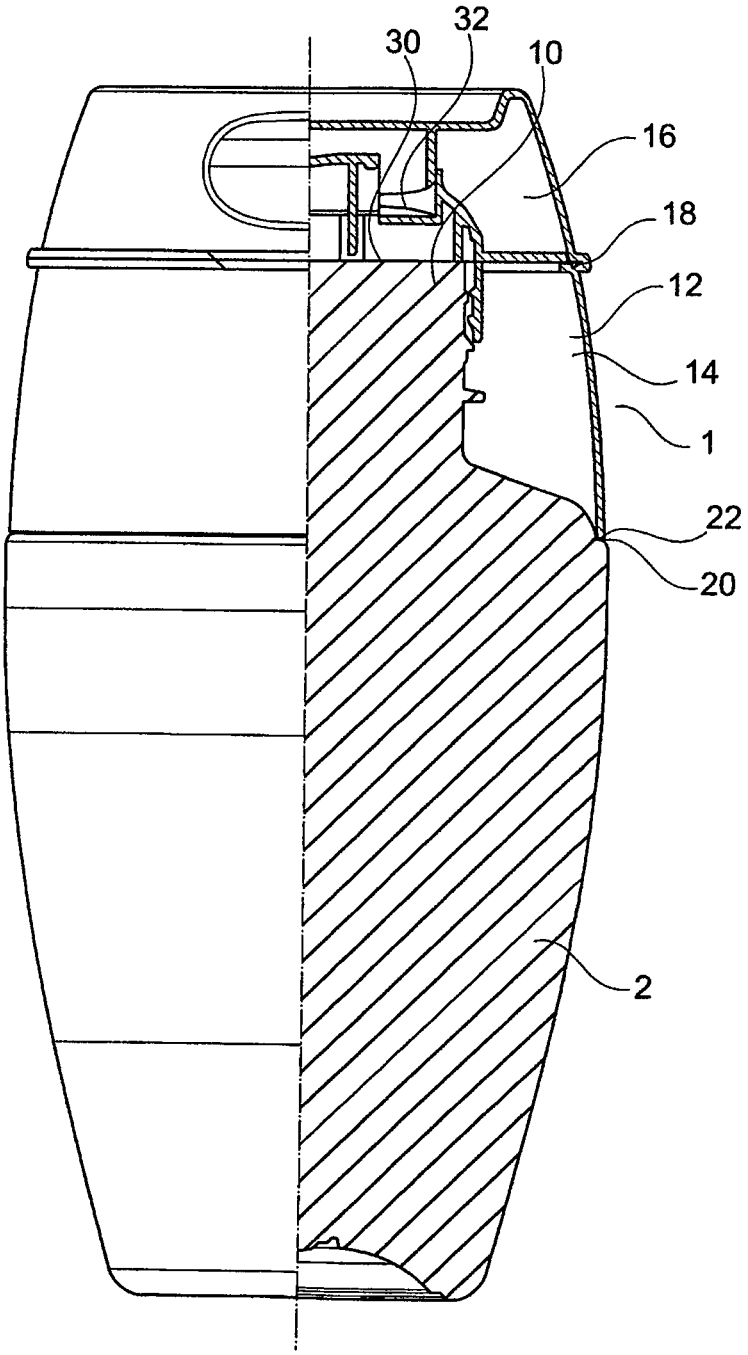
FIG. 3 shows a schematic side view of a third container according to the present disclosure.

FIG. 3 shows a schematic side section view of an embodiment of the container 1 according to the present disclosure with a cover module 12 and a body 2. The cover flap 16 is again connected via an integral hinge 18 to the second side wall 14. The second side wall 14 lies on its lower edge 22 on a placement edge 20. In the embodiment shown, the discharge opening 10 is closed by a first closing mechanism 30 in the form of a film. This film is cut through on first usage by a destruction mechanism 32 that is integrated into the cover flap 16, thus opening the discharge opening 10.

Figure 4:
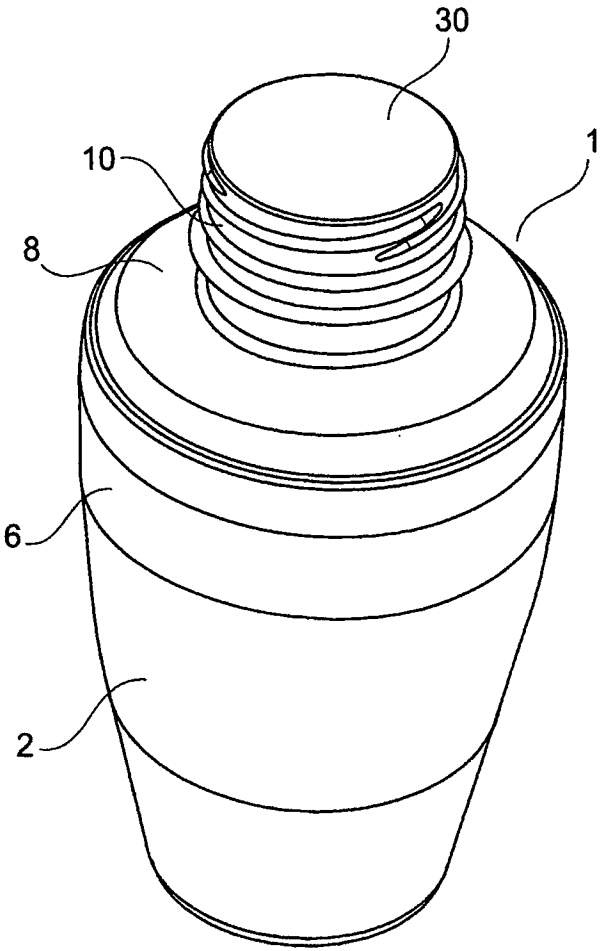
FIG. 4 shows a schematic top view onto the body of a container according to the present disclosure.

FIG. 4 shows, in a schematic perspective top view, a body 2 according to the present disclosure of an embodiment of a container 1 with the discharge opening 10 that is closed by a first closing mechanism 30 in the form of a film. The discharge opening 10 is a component of the opening section 8, which is adjacent to the first side wall 6.

Figure 5:
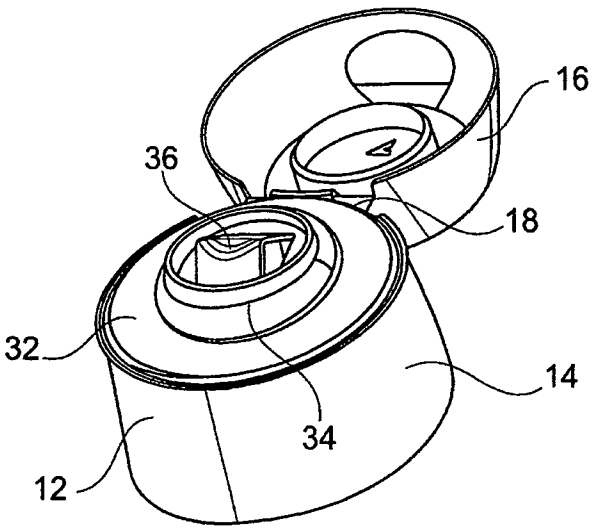
FIG. 5 shows a perspective top view onto the cover module of a container according to the present disclosure in a folded open state.

FIG. 5 shows, in a schematic top view, a cover module 12 of an embodiment of a container according to the present disclosure. The cover flap 16 is arrested in a folded open state, and is connected via an integral hinge 18 to the second side wall 14. The cover module 12 furthermore has an end area 32 with a circumferential drinking edge or circumferential drinking aid 34 that is located above the discharge opening 10. A destruction unit 36 can also be seen in FIG. 5, which can, e.g., be operated with a thumb, i.e., with just one hand, in order to penetrate the first closing mechanism in the form of the protective film 30 (not shown) of the discharge opening 10.

The features disclosed in the above description, in the claims, and in the drawings can be essential both individually as well as in any combination for the realization of the invention in its various embodiments.

The invention claimed is:

1. A beverage container comprising:

a body for receiving fluids, having a base, a first side wall adjoining the base, and an opening section adjoining the first side wall and having a discharge opening;

a cover module that can be placed on or is present on the body and has a second side wall and a cover flap adjacent thereto, wherein, when the cover module is present on the body, the first and second side walls form an outline shape of the container, at least in sections, the diameter of which runs through at least one diameter maximum in a longitudinal direction of the container; and at least one film that, at least in regions, rests on the first and second side walls and extends on one side and an opposite side of the body at the at least one diameter maximum, wherein the cover module is connected by way of the film to the body in such a manner that the cover module cannot be lost, wherein the container further comprises a separate first closing mechanism for the discharge opening, in which the first closing mechanism of the discharge opening comprises a destructible metal and/or plastic film, and wherein the cover module comprises a destruction unit for opening the first closing mechanism.

2. The beverage container according to claim 1, wherein the film is a shrink film, and wherein the shrink film, at least in regions, rests on the first and second side walls.

3. The beverage container according to claim 2, wherein the shrink film extends in a direction of the cover module at a maximum through to the cover flap.

4. The beverage container according to claim 1, wherein the cover flap comprises a second closing mechanism for the discharge opening on a side of the body facing towards the discharge opening, wherein the second closing mechanism closes the discharge opening when the cover flap is closed.

5. The beverage container according to claim 4, wherein the second closing mechanism is an integral closing mechanism.

6. The beverage container according to claim 1, wherein the cover module and/or the body are, at least in sections, formed from glass, plastic, ceramic, and/or metal, or comprise these materials.

7. The beverage container according to claim 1, wherein the cover module further comprises an end area that is connected to the second side wall.

8. The beverage container according to claim 7, wherein the end area comprises at least one drinking aid or a drinking edge that surrounds the discharge opening when the cover module is present on the body.

9. The beverage container according to claim 1, wherein the cover flap is supported movably by way of a hinge.

10. The beverage container according to claim 9, wherein the hinge is an integral hinge.

11. The beverage container according to claim 1, wherein the cover flap is arrestable in an open state.

12. The beverage container according to claim 1, wherein the opening section has at least one first attachment element, and the cover module has at least one second attachment element that is complementary to the first attachment element, wherein due to interaction between the first and second attachment elements, the body and cover module are connectable in a reversible manner.

13. The beverage container according to claim 12, wherein the first and second attachment elements comprise threads that complement each other.

14. The beverage container according to claim 1, wherein the first and second side walls form, at least in regions, a concave outline shape that comprises the at least one diameter maximum.

15. The beverage container according to claim 1, wherein the diameter maximum of the outline shape lies in the region of the first side wall.

16. The beverage container according to claim 1, wherein the first and second side walls essentially merge with each other seamlessly.

17. The beverage container according to claim 1, wherein the first side wall has a circumferential placement edge onto which an edge of the second side wall is placed.

18. The beverage container according to claim 1, wherein the first closing mechanism is screwable onto the discharge opening.

19. The beverage container according to claim 1, wherein the cover flap is arrestable in a closed state.

20. The beverage container according to claim 1, wherein the diameter maximum of the outline shape lies in the region of the second side wall.

* * * * *

UNITED STATES PATENT AND TRADEMARK OFFICE

CERTIFICATE OF CORRECTION

PATENT NO. : 8,991,631 B2
APPLICATION NO. : 13/990775
DATED : March 31, 2015
INVENTOR(S) : Joachim Kalchmair et al.

It is certified that error appears in the above-identified patent and that said Letters Patent is hereby corrected as shown below:

On the Title Page

Item (73):
"Red Bull GmbH, Puschl Am See (AT)" should read as --Red Bull GmbH, Fuschl Am See (AT)--

Signed and Sealed this
Third Day of November, 2015

Michelle K. Lee

Michelle K. Lee
*Director of the United States Patent and Trademark Office*